US010730311B2

(12) United States Patent
Profaca et al.

(10) Patent No.: US 10,730,311 B2
(45) **Date of Patent: *Aug. 4, 2020**

(54) ROBUST COMPLIANCE FOR USE IN INKJET PRINTER

(71) Applicant: Memjet Technology Limited, Dublin (IE)

(72) Inventors: Mark Profaca, North Ryde (AU); Gilbert Alemana, North Ryde (AU); Richard Dimagiba, North Ryde (AU); Brendan Shields, North Ryde (AU); Rommel Balala, North Ryde (AU)

(73) Assignee: Memjet Technology Limited (IE)

( * ) Notice: Subject to any disclaimer, the term of this patent is extended or adjusted under 35 U.S.C. 154(b) by 0 days.

This patent is subject to a terminal disclaimer.

(21) Appl. No.: 16/250,932

(22) Filed: Jan. 17, 2019

(65) Prior Publication Data

US 2019/0152231 A1 May 23, 2019

Related U.S. Application Data

(63) Continuation of application No. 15/582,985, filed on May 1, 2017, now Pat. No. 10,245,840.

(60) Provisional application No. 62/330,785, filed on May 2, 2016, provisional application No. 62/330,782, filed on May 2, 2016.

(51) Int. Cl.
*B41J 2/175* (2006.01)
*B41J 2/18* (2006.01)

(52) U.S. Cl.
CPC ..... *B41J 2/17596* (2013.01); *B41J 2/175* (2013.01); *B41J 2/17509* (2013.01); *B41J 2/17556* (2013.01); *B41J 2/18* (2013.01)

(58) Field of Classification Search
CPC .... B41J 2/175; B41J 2/17509; B41J 2/17556; B41J 2/18; B41J 2/17596
See application file for complete search history.

(56) References Cited

U.S. PATENT DOCUMENTS 10,245,840 B2 * 4/2019 Profaca ..... B41J 2/17556

* cited by examiner

*Primary Examiner* — Lamson D Nguyen
(74) *Attorney, Agent, or Firm* — Cooley LLP

(57) ABSTRACT

A compliance for use in an inkjet printer. The compliance includes flexible bellows configured for dampening pressure fluctuations in a fluid, wherein the bellows comprise a plurality of concentric portions joined via concertinaed sidewalls.

20 Claims, 4 Drawing Sheets

ROBUST COMPLIANCE FOR USE IN INKJET PRINTER

CROSS-REFERENCE TO RELATED APPLICATIONS

The present application is a continuation of U.S. application Ser. No. 15/582,985 filed May 1, 2017, which claims the benefit of priority under 35 U.S.C. § 119(e) of U.S. Provisional Application No. 62/330,785, entitled INK DELIVERY SYSTEM FOR SUPPLYING INK TO MULTIPLE PRINTHEADS AT CONSTANT PRESSURE, filed May 2, 2016 and of U.S. Provisional Application No. 62/330,782, entitled INK DELIVERY SYSTEM WITH ROBUST COMPLIANCE, filed May 2, 2016, the contents of each of which are incorporated herein by reference in their entirety for all purposes.

The present application is related to U.S. application Ser. No. 15/582,998 filed May 1, 2017 and to U.S. application Ser. No. 15/583,099 filed on May 1, 2017, the contents of each of which are hereby incorporated by reference in their entirety for all purposes.

FIELD OF THE INVENTION

This invention relates to an ink delivery system for an inkjet printer. It has been developed primarily for supplying ink to multiple printheads at a relatively constant pressure.

BACKGROUND OF THE INVENTION

Inkjet printers employing Memjet® technology are commercially available for a number of different printing formats, including small-office-home-office ("SOHO") printers, label printers and wideformat printers. Memjet® printers typically comprise one or more stationary inkjet printheads, which are user-replaceable. For example, a SOHO printer comprises a single user-replaceable multi-colored printhead, a high-speed label printer comprises a plurality of user-replaceable monochrome printheads aligned along a media feed direction, and a wideformat printer comprises a plurality of user-replaceable printheads in a staggered overlapping arrangement so as to span across a wideformat pagewidth.

Supplying ink to multiple printheads can be problematic as the number of printheads increases. In order to maintain high print quality, each printhead should receive ink at about the same ink pressure from a common ink tank. One system for supplying ink to multiple inkjet printheads is described in U.S. Pat. No. 8,480,211, the contents of which are incorporate herein by reference. In the prior art system, a common accumulator tank incorporating a pressure control system (e.g. float valve regulator) feeds ink to multiple printheads via an ink supply line. A return ink line enables various priming, de-priming and purging operations when the printheads are not printing. However, a problem with the ink delivery system described in U.S. Pat. No. 8,480,211 is that not all printheads necessarily receive the same ink pressure. Printheads furthest from the accumulator tank are affected by pressure drops across printheads closer to the accumulator tank. Hence, there is a tendency for printheads to experience difference ink pressures, especially when printing at full bleed or when different printheads in the system have different ink demands.

It would be desirable to provide an ink delivery system, which supplies ink to multiple printheads at a reliable and highly controlled hydrostatic ink pressure. It would further be desirable to provide an ink delivery system, which can be adapted to supply ink to multiple printheads, the number of which may vary from printing system to printing system. It would be further desirable to provide individual and consistent pressure dampening for each printhead.

SUMMARY OF THE INVENTION

In a first aspect, there is provided an inkjet printer comprising:

at least one inkjet printhead;

an ink line connected to the printhead; and a compliance fluidically communicating with the ink line, the compliance comprising sealed flexible bellows configured for dampening ink pressure fluctuations in the ink line.

Preferably, the bellows comprise a plurality of concentric portions joined together via concertinaed sidewalls.

Preferably, the concentric portions have sequentially decreasing diameter away from a bellows.

Preferably, a number of the concentric portions at least partially determines a dampening effect of the compliance.

Preferably, a thickness of the sidewalls at least partially determines a dampening effect of the compliance.

Preferably, the flexible bellows, in use, extend downwards from a bellows inlet towards a base.

In a related aspect, there is provided a print module comprising:

a supply module having at least one port for connection to an ink line; and an inkjet printhead coupled to the supply module for receiving ink therefrom, wherein the supply module comprises a compliance fluidically communicating with the ink line, the compliance comprising sealed flexible bellows configured for dampening ink pressure fluctuations in the ink line.

Preferably, the supply module comprises:

an inlet module coupled to an inlet of the printhead, the inlet module having an inlet port for connection to an ink inlet line; and an outlet module coupled to an outlet of the printhead, the outlet module having an outlet port for connection to an ink outlet line, wherein at least one of the inlet and outlet modules comprises the compliance.

Preferably, each of the inlet and outlet modules comprises a respective compliance.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
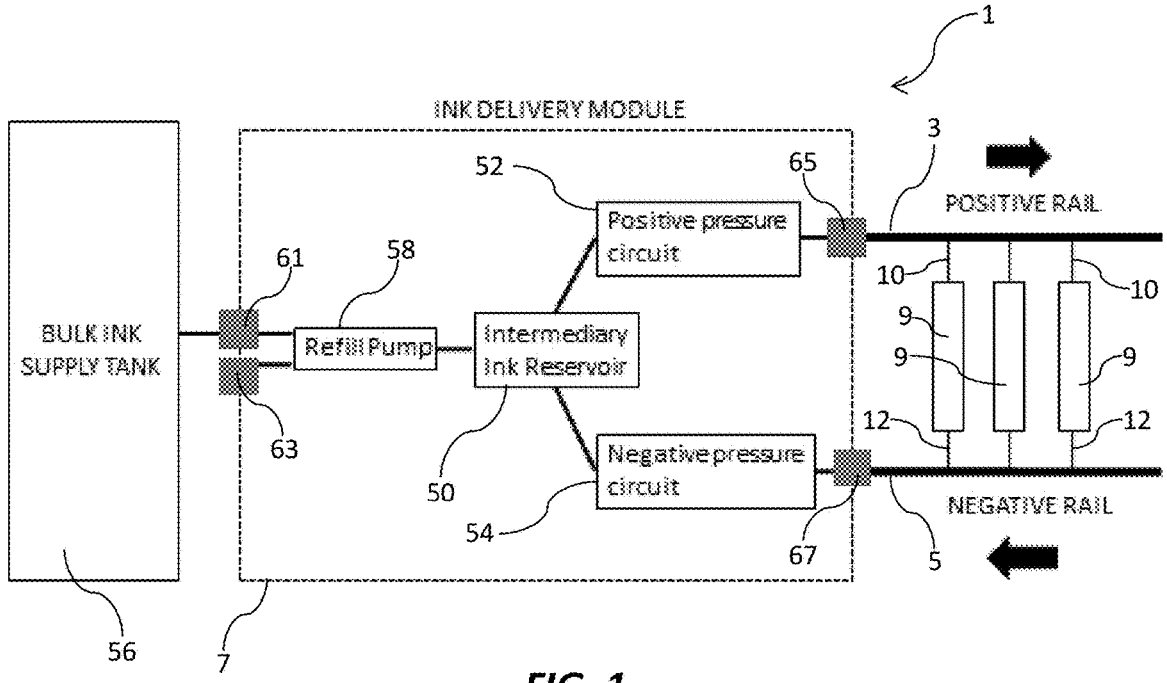
FIG. 1 shows schematically an ink delivery system according to the present invention.

Referring to FIG. 1, there is shows schematically an ink delivery system 1 comprising a positive ink line 3 ("positive rail") and a negative ink line 5 ("negative rail") connected to an ink delivery module 7, which regulates the ink pressure in each of the positive and negative ink lines. A plurality of print modules 9 are interconnected between the positive ink line 3 and the negative ink line 5 via respective inlet and outlet lines 10 and 12. Although three print modules 9 are shown in FIG. 1, it will be appreciated that any number of print modules may be interconnected between the positive ink line 3 and the negative ink line 5. Print modules 9 may be physically positioned in a staggered overlapping arrangement so as to extend across a print zone media wider than an individual print module. In this way, multiple print modules 9 may be employed for printing onto print media having widths of more than about 8 inches (e.g. at least 16 inches, at least 32 inches or at least 40 inches).

Figure 3:
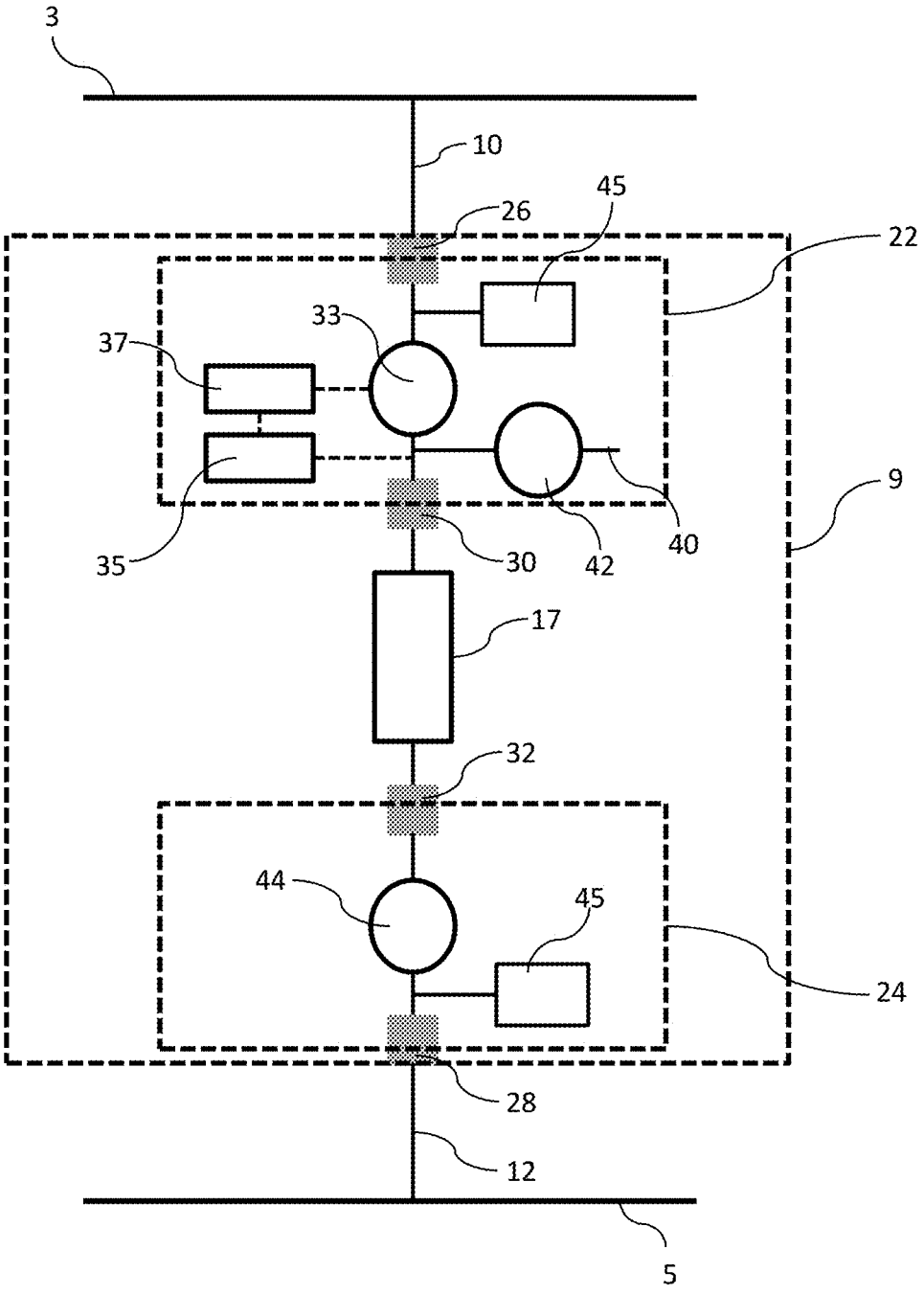
FIG. 3 shows schematically a print module interconnected between positive and negative ink lines.
Figure 4:
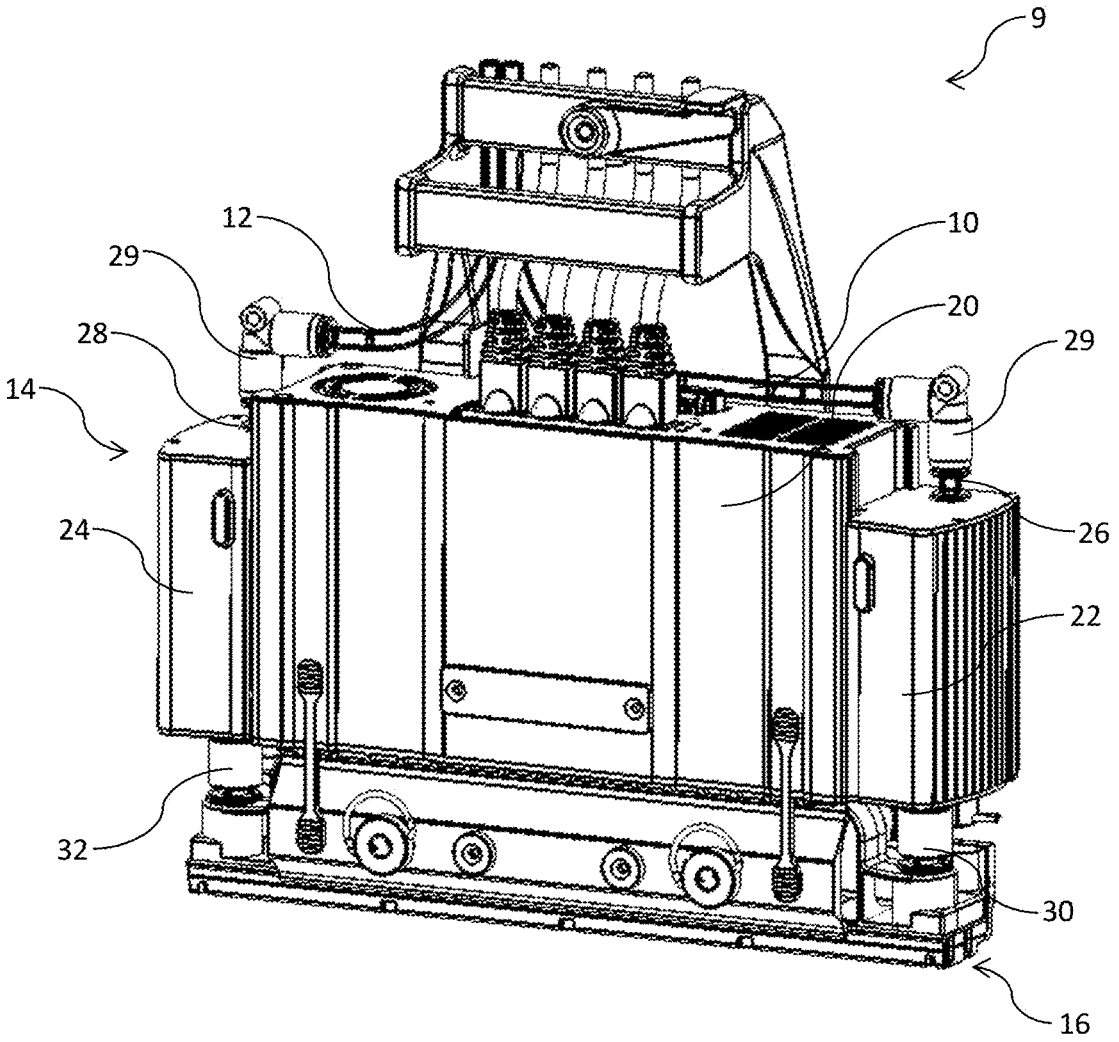
FIG. 4 is a perspective view of a print module.

Referring now to FIGS. 3 and 4, an individual print module 9 is comprised of a supply module 14 and a printhead cartridge 16 releasably connected to the supply module. The printhead cartridge 16 comprises an inkjet printhead 17 for printing onto print media and may be a color or monochrome printhead (e.g. two color or four color printhead), as known in the art. For example, the printhead may of the type described in the U.S. Pat. No. 10,399,354, the contents of which are incorporated herein by reference. In the interests of clarity, an ink delivery system for one color of ink is described herein, although it will be appreciated that multiple ink delivery systems may be used for supply of multiple colors of ink.

The supply module 14 comprises a body 20 housing drive and logic circuitry (e.g. one or more PCBs having a print engine controller chip, drive transistors etc) for the printhead 17, as well as an inlet module 22 and an outlet module 24. The inlet module 22 has an inlet port 26 connected to the inlet line 10, and the outlet module 24 has an outlet port 28 connected to the outlet line 12. Suitable print module couplings 29 allow convenient replacement of entire print modules, when required.

The printhead cartridge 16 is fluidically connected to the supply module 14 by means of printhead inlet and outlet couplings 30 and 32. The printhead inlet and outlet couplings 30 and 32 are typically quick-connect couplings which enable convenient removal of a spent printhead cartridge 16 from each print module 9 and replacement with a new printhead cartridge by the user.

The inlet module 22 contains all the necessary components for providing local control of ink pressure in the printhead 17 for a respective print module 9. Thus, each print module 9 provides local, independent control of ink pressure in its respective printhead 17, so that local ink pressures can be fine-tuned automatically and in response to localized pressure fluctuations.

The inlet module 22 contains a control valve 33, which regulates ink pressure dynamically in response to feedback from an ink pressure sensor 35 sensing ink pressure downstream of the control valve. The ink pressure sensor 35 provides feedback to a controller 37 (e.g. microprocessor), which in turn controls a variable position of the control valve 33 so as to regulate ink pressure in the printhead 17 within a predetermined backpressure range. Notably, the control valve 33 allows fine control of ink pressure with minimal hysteresis by virtue of being connected between the positive and negative ink lines 3 and 5, which already provide gross control of ink pressure. Hence, relatively large adjustments of the control valve 33 produce only relatively small changes in ink pressure in the print module 9.

Additionally, the inlet module 22 comprises an air inlet 40 for introducing air into the printhead and a corresponding air valve 42, which can shut off air flow into the printhead. The air valve 42 is typically a solenoid valve, which may be controlled by the controller 37. For most operations the air valve 42 is closed. However, when it is necessary to de-prime the printhead 16 (e.g. for replacement of a printhead cartridge 17), the air valve 42 is opened with the control valve 33 fully closed so as to draw air into the printhead 16 and remove ink.

The outlet module 24 comprises a shut-off valve 44 for isolating the print module 9, in combination with the control valve 33, when required. The shut-off valve 44 incorporates a flow restrictor in the form an orifice which restricts ink flow and controls backpressure in the printhead 17 in combination with the negative ink line 5.

In the embodiment shown in FIG. 3, both the inlet module 22 and the outlet module 24 each comprise a compliance 45 (e.g. an air chamber or flexible-walled chamber) proximal the respective inlet and outlet ports 26 and 28 for dampening ink pressure fluctuations or 'spikes'.

Hitherto, the Assignee has described air compliance chambers for dampening ink pressure fluctuations (see, for example, U.S. Pat. No. 8,926,072, the contents of which are incorporated herein by reference). However, air compliance chambers may not be suitable for incorporation into the print module 9 for a number of reasons: (1) a large volume of space is required to dampen relatively low frequency pressure fluctuations; (2) air is generally undesirable in ink delivery systems, especially those used for delivering pigment-based inks; (3) different print modules may end up with different volumes of air in respective compliance chambers, which may result in inconsistent print quality for different print modules.

Figure 5:
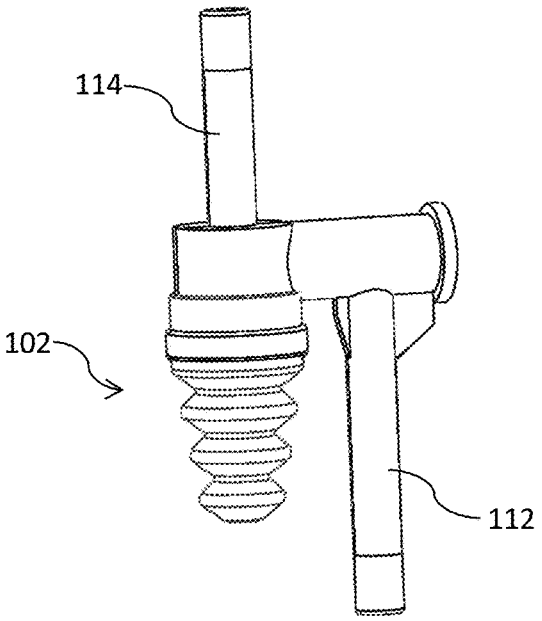
FIG. 5 is a perspective view of a compliance assembly.
Figure 6:
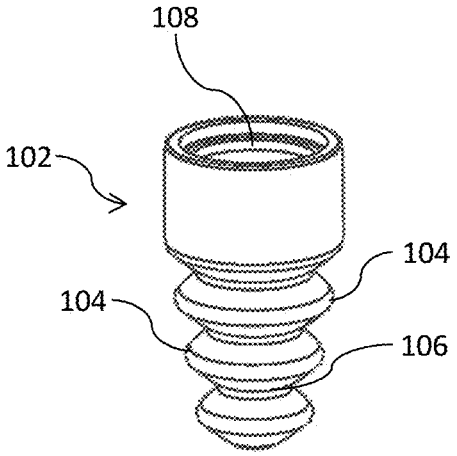
FIG. 6 is a perspective view of a compliance having flexible bellows.
Figure 7:
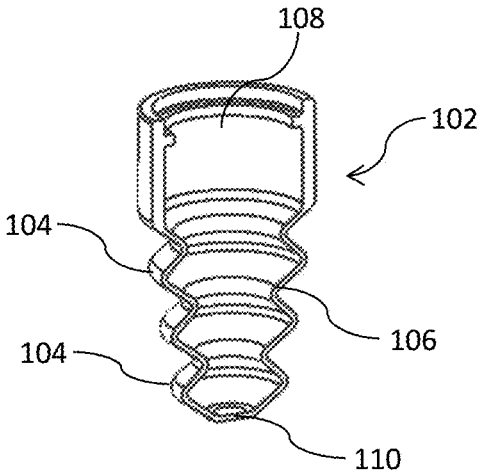
FIG. 7 is a sectional perspective of the compliance shown in FIG. 6.

Referring to FIGS. 5 to 7, there is shown a compliance comprising sealed flexible bellows 102 for dampening ink pressure fluctuations. The bellows 102 comprise a plurality of concentric portions 104 (or ribs) joined via concertinaed sidewalls 106. The bellows 102 extend generally downwards from a bellows inlet 108 towards a base 110, and the concentric portions 104 have sequentially decreasing diameters towards the base. The bellows inlet 108 is sealingly connected to a compliance ink line in which ink flows generally upwards from a compliance inlet line 112 towards a compliance outlet line 114. Accordingly, in use, the bellows 102 are filled completely with ink and the flexible nature of the sidewalls 106 enables dampening of ink pressure fluctuations. The bellows 102 are formed of a single molded material having a suitable Young's modulus. The material forming the bellows 102 is not particularly limited and may, for example, be any suitably compliant polymer (e.g. silicone, polyurethane, rubber etc.) Depending on the dampening effect required, the number of concentric portions 104 as well as the thickness of the sidewalls 106 may be varied for optimal pressure dampening. In the example shown in FIGS. 5 to 7, there are three concentric portions 104 although it will be appreciated that the bellows 102 may comprise any number of concentric portions (e.g. from 1 to 10) depending on the degree of dampening required.

From the foregoing, it will appreciated be that the flexible bellows 102 provide effective and consistent dampening of ink pressure fluctuations whilst consuming minimal space in the print module 9. Advantageously, the compliances 45 of the inlet module 22 and outlet module 24 shown in FIG. 3 may both comprise the flexible bellows 102 as described herein.

Returning to FIG. 1, the ink delivery module 7 comprises an intermediary ink reservoir 50 which is connected to the positive ink line 3 via a positive pressure circuit 52 and connected to the negative ink line via a negative pressure circuit 54. The intermediary ink reservoir is vented to atmosphere via, for example, a serpentine vent path (not shown). The positive pressure circuit 52 regulates a positive ink pressure in the positive ink line 3, while the negative pressure circuit 54 regulates a negative ink pressure in the negative ink line 5. During printing, ink circulates from the intermediary ink reservoir 50 into the positive ink line 3, through each print module, 8 and returns to the intermediary ink reservoir via the negative ink line 5.

The intermediary ink reservoir 50 is replenished with ink from a bulk ink supply tank 56 via a refill pump 58 in the ink delivery module 7. The intermediary ink reservoir 50 has suitable ink sensors (not shown) for detecting a low ink level and providing feedback for actuating the refill pump 58 when required.

The ink delivery module 7 is typically a self-contained unit with various external couplings: a supply coupling 61 for connecting the refill pump 58 to the bulk ink supply tank 56; an overflow coupling 63 for connecting the refill pump to an overflow tank (now shown); a positive line coupling 65 for connecting the positive ink line 3 to the positive pressure circuit 52; and a negative line coupling 67 for connecting the negative ink line 5 to the negative pressure circuit 54.

Figure 2:
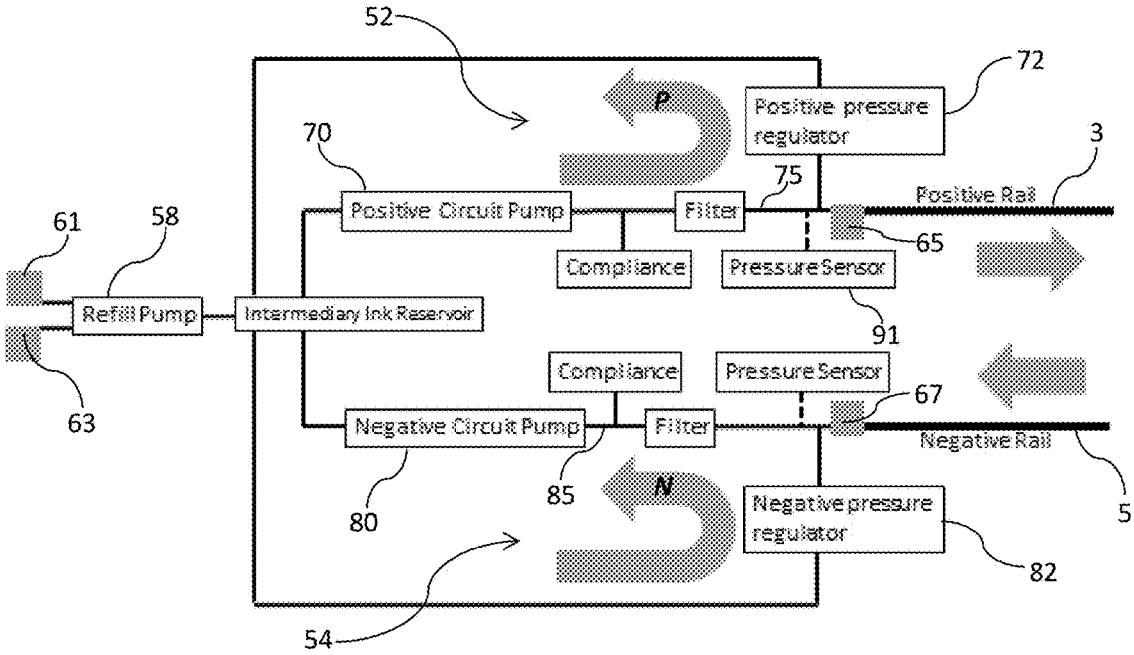
FIG. 2 shows schematically an ink delivery module for connection to positive and negative ink lines.

Turning now to FIG. 2, the internal components of the ink delivery module 7 are shown in more detail. In particular, the positive pressure circuit 52 comprises a positive circuit pump 70, which pumps ink from the intermediary ink reservoir 50 towards a positive pressure regulator 72. Ink between the positive circuit pump 70 and the positive pressure regulator 72 is maintained at a regulated positive pressure, and the positive ink line 3 is tapped from this regulated portion 75 of the positive pressure circuit 52 via the positive line coupling 65. Downstream of the positive pressure regulator 72, ink is at unregulated pressure and returns to the intermediary ink reservoir 50 in the direction indicated by the arrow P in FIG. 4.

Similarly, the negative pressure circuit 54 comprises a negative circuit pump 80, which pumps ink from the intermediary ink reservoir 50, through a negative pressure regulator 82 and into a pump inlet of the negative circuit pump. Ink between the negative pressure regulator 82 and the negative circuit pump 80 and is maintained at a regulated negative pressure, and the negative ink line 5 is tapped from this regulated portion 85 of the negative pressure circuit 54 via the negative line coupling 67. Downstream of the negative circuit pump 80, ink is at unregulated pressure and returns to the intermediary ink reservoir 50 in the direction indicated by the arrow N in FIG. 4.

In each of the positive and negative pressure circuits 52 and 54, a pressure sensor 91 provides feedback to the respective positive and negative pressure regulators 72 and 82. Therefore, the regulated portions 75 and 85 of each circuit are maintained at optimum positive and negative pressures, respectively. Each of the positive and negative pressure circuits 52 and 54 further comprises a filter for filtering particulates from ink and a compliance for dampening ink pressure fluctuations.

During printing, ink is circulated around the positive pressure circuit 52 and the regulated portion 75 of the circuit supplies ink to the positive ink line 3. Each print module 9 draws ink from the positive ink line 3 and returns ink to the regulated portion 85 of the negative pressure circuit 54 via the negative ink line 5. By maintaining control of the relative positive and negative pressures in the circuits 52 and 54, a relatively constant backpressure is provided at each print module 9 connected between the positive and negative ink lines 3 and 5. Additional local control of backpressure in each printhead 17 is provided by the control valve 33 in the input module 22 of each print module 9. The control valve 33 is frequently adjusted using feedback from the ink pressure sensor 35 to maintain optimum backpressure. When the pressure is too high, the control valve 33 is closed somewhat; when the pressure is too low, the control valve 33 is opened somewhat.

Accordingly, the present invention provides excellent control of printhead backpressures in a number of printheads 17 which are supplied with ink from a common ink reservoir. The combination of bulk pressure regulation via the positive and negative pressure circuits 52 and 54 and local pressure regulation via the control valve 33 in each print module ensures that each printhead 17 has sufficient ink pressure for different ink demands and, further, that each printhead in the system is maintained at a relatively constant backpressure.

It will, of course, be appreciated that the present invention has been described by way of example only and that modifications of detail may be made within the scope of the invention, which is defined in the accompanying claims.

The invention claimed is:

1. A compliance for use in an inkjet printer, the compliance comprising flexible bellows configured for dampening pressure fluctuations in a fluid, wherein the bellows comprise a plurality of concentric portions joined via concertinaed sidewalls.

2. The compliance of claim 1, wherein the bellows are sealed at one end.

3. The compliance of claim 1, wherein the concentric portions have sequentially decreasing diameter away from a bellows inlet.

4. The compliance of claim 1, wherein a number of the concentric portions at least partially determines a dampening effect of the compliance.

5. The compliance of claim 1, wherein a thickness of the sidewalls at least partially determines a dampening effect of the compliance.

6. The compliance of claim 1, wherein the flexible bellows are formed of a single molded material.

7. The compliance of claim 1, wherein, in use, the flexible bellows are filled with the fluid.

8. An inkjet printer comprising at least one compliance, the compliance comprising flexible bellows configured for dampening pressure fluctuations in a fluid subsystem of the printer, wherein the bellows comprise a plurality of concentric portions joined via concertinaed sidewalls.

9. The inkjet printer of claim 8, wherein the fluid subsystem is an ink delivery system for delivering ink to a printhead of the printer.

10. The inkjet printer of claim 8, wherein the bellows are sealed at one end.

11. The inkjet printer of claim 10, wherein the flexible bellows extend downwards from a bellows inlet towards a base.

12. The inkjet printer of claim 11, wherein the flexible bellows taper towards the base.

13. The inkjet printer of claim 10, wherein the concentric portions have sequentially decreasing diameter away from a bellows inlet.

14. The inkjet printer of claim 8, wherein a number of the concentric portions at least partially determines a dampening effect of the compliance.

15. The inkjet printer of claim 8, wherein a thickness of the sidewalls at least partially determines a dampening effect of the compliance.

16. The inkjet printer of claim 8, wherein the flexible bellows are formed of a single molded material.

17. The inkjet printer of claim 8, wherein, in use, the flexible bellows are filled with a fluid.

18. The inkjet printer of claim 8 comprising a plurality of print modules, each print module comprising a printhead and at least one compliance.

19. A method of dampening a pressure fluctuation of a fluid in an inkjet printer, the method comprising the steps of:

communicating the fluid with a compliance, the compliance comprising flexible bellows having an inlet and a plurality of concentric portions extending away from the inlet, the concentric portions being joined via concertinaed sidewalls; and flexing the bellows so as to dampen pressure fluctuations in the fluid.

20. The method of claim 19, wherein the fluid is an ink and the compliance is connected to an ink delivery system for delivering the ink to a printhead.

* * * * *